US005863387A

United States Patent [19]

Graf

[11] Patent Number: 5,863,387

[45] Date of Patent: Jan. 26, 1999

[54] ULTRASONIC DEVICE FOR DEFLOCCULATING FIBER SUSPENSION IN A PAPER-MAKING MACHINE HEADBOX NOZZLE

[75] Inventor: Edwin X. Graf, Menasha, Wis.

[73] Assignee: Voith Sulzer Technology North America, Inc, Appleton, Wis.

[21] Appl. No.: 847,057

[22] Filed: May 1, 1997

[51] Int. Cl.[6] ..... D21F 1/02

[52] U.S. Cl. ..... 162/216; 162/336; 162/341; 162/344

[58] Field of Search ..... 162/212, 216, 162/336, 341, 344

[56] References Cited

U.S. PATENT DOCUMENTS

| | | | |
|---|---|---|---|
| 3,325,348 | 6/1967 | Bennet | 162/216 |
| 3,810,817 | 5/1974 | Arledter | 162/301 |
| 4,539,073 | 9/1985 | Andersson | 162/259 |
| 4,735,686 | 4/1988 | Skytta | 162/203 |
| 4,885,060 | 12/1989 | Beran et al. | 162/216 |
| 5,423,948 | 6/1995 | Graf et al. | 162/342 |
| 5,578,172 | 11/1996 | Graf | 162/344 |

FOREIGN PATENT DOCUMENTS

| | | | |
|---|---|---|---|
| 2110591 | 6/1972 | France | 162/209 |
| 2054101 | 5/1972 | Germany | 162/216 |

*Primary Examiner*—Karen M. Hastings
*Attorney, Agent, or Firm*—Taylor & Associates, P.C.

[57] ABSTRACT

A paper-making machine for making a paper web from a fiber suspension includes a headbox having a plurality of walls defining a chamber, and an inlet connected to at least one of the walls and disposed in fluid communication with the chamber. The inlet is configured to receive the fiber suspension. The headbox also has a discharge nozzle disposed in fluid communication with the chamber. The discharge nozzle defines an outlet from which the fiber suspension is discharged. The headbox also includes a sonic transducer, associated with the discharge nozzle, for transmitting sonic energy into the fiber suspension within the discharge nozzle and thereby substantially deflocculating the fiber suspension within the discharge nozzle.

7 Claims, 1 Drawing Sheet

ULTRASONIC DEVICE FOR DEFLOCCULATING FIBER SUSPENSION IN A PAPER-MAKING MACHINE HEADBOX NOZZLE

BACKGROUND OF THE INVENTION

1. Field of the Invention

The present invention relates to paper-making machines, and, more particularly, to an ultrasonic deflocculating device for use in paper-making machines.

2. Description of the Related Art

A paper-making machine is used for making a fiber web, such as a paper web, from a fiber suspension. The fiber suspension is typically in the form of fibers, such as wood fibers, which are suspended in water. The fiber suspension is introduced into a headbox, such as a valley (TM) or a hydraulic headbox, at the wet end of the machine. The headbox discharges the fiber suspension from an outlet of a discharge nozzle which causes the exiting fiber suspension to have a particular cross-sectional profile. The fiber suspension is transferred onto a forming fabric on the wet end of the machine as it leaves the headbox.

It is necessary to treat the fiber suspension which is introduced into the headbox such that the fiber web produced as the end product is of a particular quality with minimal defects. Fox example, the fiber suspension may be cleaned and bleached prior to introduction into the headbox. Another factor associated with the fiber suspension which tends to affect the quality of the fiber web is the tendency of the fibers within the fiber suspension to clump together, which may also ultimately result in clumps of fibers within the produced fiber web. Such clumping is believed to be a result of hydro entanglement of the fibers during which the fibers spin together and become tangled. The clumped fibers are not solid particles, but rather are tangled fibers. The tendency of the fibers within the fiber suspension to clump together is known as "flocculation" of the fiber suspension.

It is known to place a mechanical device within the headbox for the purpose of agitating the fiber suspension and thereby deflocculating the fiber suspension. For example, one or more rotatable rolls may be placed within the headbox. Such rolls, known as distributor rolls, typically are in the form of hollow rolls with a plurality of perforations at the periphery thereof. Rotation of the distributor rolls agitates the fiber suspension and deflocculates the fiber suspension within the headbox.

Further, it is known to place a vertical partition within a headbox for the purpose of deflocculating the fiber suspension. For example, U.S. Pat. No. 5,277,765 (Graf), assigned to the assignee of the present invention, discloses a vertical partition with a cross-sectional profile which provides effective deflocculation of the fiber suspension within the headbox within a range of flow rates of the fiber suspension.

With the use of the above-mentioned mechanical deflocculation devices, flow disturbances such as so-called "eddy currents", or "eddies", or microcurrents, occur within the fiber suspension at the walls of the headbox. Eddies are caused by adhesion between the walls and the fiber suspension, and may be detrimental to paper quality.

Another problem with the above-mentioned deflocculation devices is that reflocculation occurs in the fiber suspension before it exits the discharge nozzle of the headbox. Known deflocculation devices as described above are placed either within the inlet portion or the main chamber of the headbox. However, reflocculation can occur after deflocculation within a fraction of a second after the fiber suspension flows out of the effective range of the deflocculation device. The fiber suspension flows through the headbox at a rate which is slow enough to allow the fiber suspension to reflocculate before leaving the headbox. Known deflocculation devices may therefore not totally prevent the formation of "flocs" in the paper web.

It is also known to place an ultrasonic device within an explosion block associated with an inlet of a headbox. The ultrasonic device, in conjunction with the explosion block, functions to suspend solid particles such as clays, fillers, fines, colors, pigments, and/or mercury within a fiber suspension in a paper-making machine. The ultrasonic device and explosion block conjunctively break up the solid matter into very fine particles which may be then adequately suspended within the fiber suspension. Such an ultrasonic device is not used for deflocculation of the fiber suspension, and in fact would not even inherently work for effective deflocculation of the fiber suspension. That is, reflocculation of the fiber suspension would quickly occur within the headbox since such an ultrasonic device is placed at the inlet to the headbox, as indicated above with respect to mechanical deflocculation devices.

What is needed in the art is a device which deflocculates the fiber suspension immediately prior to discharge from the headbox such that reflocculation does not occur, and which does not obstruct the flow of the fiber suspension through the discharge nozzle or create eddies.

SUMMARY OF THE INVENTION

The present invention provides a device to deflocculate the fiber suspension within the discharge nozzle of the headbox of a paper-making machine that does not obstruct the flow of the fiber suspension through the discharge nozzle and that does not create eddies.

The invention comprises, in one form thereof, a paper-making machine for making a paper web from a fiber suspension. The paper-making machine includes a headbox having a plurality of walls defining a chamber, and an inlet connected to at least one of the walls and disposed in fluid communication with the chamber. The inlet is configured to receive the fiber suspension. The headbox also has a discharge nozzle disposed in fluid communication with the chamber. The discharge nozzle defines an outlet from which the fiber suspension is discharged. The headbox also includes a sonic transducer, associated with the discharge nozzle, for transmitting sonic energy into the fiber suspension within the discharge nozzle and thereby substantially deflocculating the fiber suspension within the discharge nozzle.

An advantage of the present invention is that the fiber suspension is deflocculated over the entirety of its path through the discharge nozzle of the headbox, resulting in improved paper quality.

Another advantage is that the fiber suspension is deflocculated immediately prior to discharge from the discharge nozzle, thereby reducing the possibility of reflocculation within the fiber suspension.

Yet another advantage is that the flow of the fiber suspension through and out of the discharge nozzle is not obstructed.

Still another advantage is that eddies and other flow disturbances are not created in the course of deflocculating the fiber suspension.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
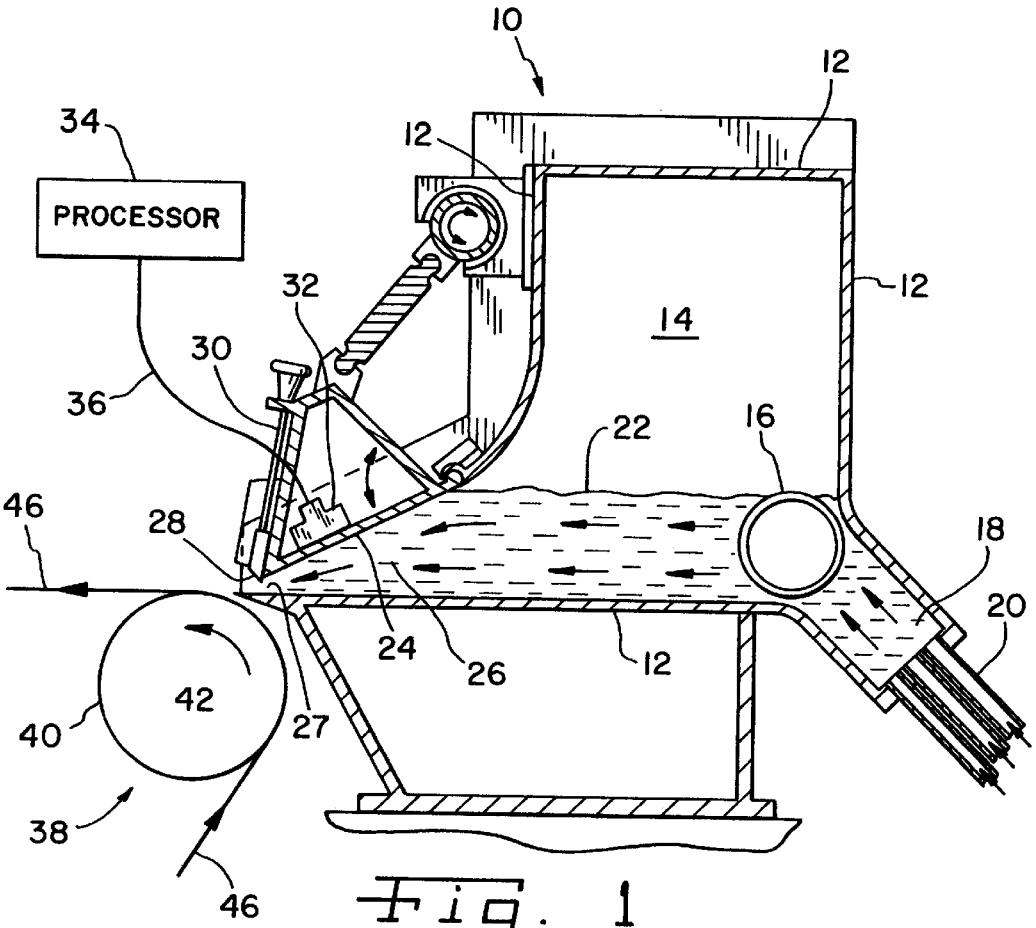
FIG. 1 is a schematical, side view of a headbox including an embodiment of a sonic deflocculator of the present invention.

Referring now to the drawings, and more particularly to FIG. 1, there is shown an embodiment of a headbox 10 which defines a part of and is disposed at a wet end of a paper-making machine for forming a fiber web (such as a paper web) from a fiber suspension.

Headbox 10 includes a plurality of walls 12 which define a chamber 14 therein. Disposed within chamber 14 is an optional distributor roll 16 which is rotatably carried by opposing side walls 12. Distributor roll 16 includes perforations on its outer surface and rotates to induce microturbulance within the fiber suspension flow and thereby deflocculate the fiber suspension. In the embodiment shown in FIG. 1, chamber 14 contains one distributor roll 16. However it is to be understood that any number of distributor rolls 16 can be placed within chamber 14. In another embodiment (not shown), a vertical partition, movable in a vertical direction, may be inserted into the fiber suspension flow during low flow rate conditions to further deflocculate the fiber suspension within chamber 14.

Walls 12 of headbox 10 also define an inlet 18 which is disposed in fluid communication with chamber 14. Inlet 18 receives the fiber suspension from tube bundle 20, as is known. The fiber suspension introduced into headbox 10 through inlet 18 has a flow level 22 within chamber 14. The area of chamber 14 above flow level 22 is an air space which is pressurized to a predetermined operating pressure through the use of appropriate structure (not shown), as is known.

Headbox 10 also includes a slice beam 24 which together with the bottom wall 12 define a discharge nozzle 26 and outlet 27. A slice lip 28 disposed at the outlet 27 of discharge nozzle 26 has a height, measured in a vertical direction, which is adjustable across the width of slice lip 28 using a plurality of spindles attached thereto, one of which is shown and referenced 30 in FIG. 1. Coarse adjustment of discharge nozzle 26 may be achieved by pivotally moving slice beam 24, as is known. Discharge nozzle 26 and slice lip 28 are thus adjusted to discharge a predetermined amount of the fiber suspension from headbox 10.

A forming section 38 is shown only partially in FIG. 1.

Forming 38 includes a breast roll 40 which rotates as indicated by arrow 42 and carries an endless wire 46. Breast roll 40 is positioned adjacent to the outlet 27 of discharge nozzle 26 for receiving the fiber suspension 27 which is discharged therefrom.

Figure 2:
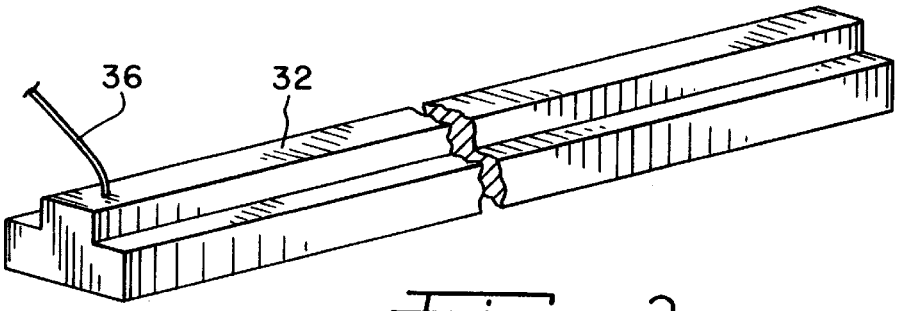
FIG. 2 is a perspective, fragmentary view of the sonic deflocculator shown in FIG. 1.

According to the present invention, a sonic deflocculator such as a sonic transducer 32 (FIGS. 1 and 2) is mounted across the width of an upper surface of slice beam 24. Sonic transducer 32 is connected to and controlled by processor 34 through conductor 36. Sonic transducer 32 is shown as having a cross section including a smaller rectangular area atop a larger rectangular area. However, it is to be understood that sonic transducer 32 can have a cross section of virtually any shape.

Sonic transducer 32 provides sonic energy to the fiber suspension within discharge nozzle 26, which functions to deflocculate the fiber suspension within discharge nozzle 26. Where in this application the term "sonic" is used, it is to be understood that the term may include the meaning of the term "ultrasonic." That is, "sonic" may or may not include frequencies above 20 kHz. Sonic transducer 32 is preferably an ultrasonic transducer, emitting ultrasonic energy with a frequency above 20 kHz, so that a higher energy level is transmitted into the fiber suspension.

Sonic transducer 32 is shown as being one continuous transducer across the width of slice beam 24. In another embodiment (not shown), multiple sonic transducers 32 of shorter width can be substantially evenly spaced across slice beam 24. Each sonic transducer 32 can be driven by the same processor 34 through corresponding parallel conductors 36. Alternatively, sonic transducers 32 can be powered by processor 34 in a series circuit loop configuration with adjacent sonic transducers 32 being interconnected through a corresponding conductor 36.

In use, sonic transducer 32 receives AC energy from processor 34 through conductor 36. Sonic transducer 32, which can be for example magnetostrictive or piezoelectric, emits a level of sonic energy sufficient to break up clumps in, agitate and disperse the fiber suspension moving along a path through discharge nozzle 26. Positioning sonic transducer 32 in association with discharge nozzle 26 assures that the fiber suspension is deflocculated immediately prior to being discharged from outlet 27. In this way, it is assured that the fiber suspension exits discharge nozzle 26 and is deposited on an endless wire 46 in a deflocculated state.

While this invention has been described as having a preferred design, the present invention can be further modified within the spirit and scope of this disclosure. This application is therefore intended to cover any variations uses, or adaptations of the invention using its general principles. Further, this application is intended to cover such departures from the present disclosure as come within known or customary practice in the art to which this invention pertains and which fall within the limits of the appended claims.

What is claimed is:

1. A paper-making machine for making a paper web from a fiber suspension, said paper-making machine including a headbox, said headbox comprising:

a plurality of walls defining a chamber;

an inlet connected to at least one of said walls and disposed in fluid communication with said chamber, said inlet configured to receive the fiber suspension;

a discharge nozzle disposed in fluid communication with said chamber, said discharge nozzle defining an outlet from which the fiber suspension is discharged, said discharge nozzle continuously tapering to and terminating at said outlet to cause a fluid shear in the fiber suspension, said discharge nozzle having a width extending substantially parallel to said outlet; and ultrasonic means, connected and disposed immediately adjacent to said discharge nozzle upstream from said outlet, for transmitting ultrasonic energy into the fiber suspension within said discharge nozzle and thereby substantially deflocculating the fiber suspension within said discharge nozzle, said ultrasonic means extending continuously across said width of said discharge nozzle.

2. The paper-making machine of claim 1, wherein said ultrasonic means is mounted on said discharge nozzle.

3. The paper-making machine of claim 1, further comprising a source of electrical power connected to and configured to energize said ultrasonic means.

4. The paper-making machine of claim 1, further comprising a slice beam, said slice beam defining said discharge nozzle, said ultrasonic means being mounted on said slice beam.

5. The paper-making machine of claim 1, wherein said outlet has an adjustable height.

6. A paper-making machine for making a paper web from a fiber suspension, said paper-making machine including a headbox, said headbox comprising:

a plurality of walls defining a chamber;

an inlet connected to at least one of said walls and disposed in fluid communication with said chamber, said inlet configured to receive the fiber suspension;

a discharge nozzle disposed in fluid communication with said chamber, said discharge nozzle defining an outlet from which the fiber suspension is discharged, said discharge nozzle continuously tapering to and terminating at said outlet to cause a fluid shear in the fiber suspension, said discharge nozzle having a width extending substantially parallel to said outlet; and at least one ultrasonic transducer, connected and disposed immediately adjacent to said discharge nozzle upstream from said outlet, said at least one ultrasonic transducer configured to transmit ultrasonic energy into the fiber suspension within said discharge nozzle and thereby substantially deflocculate the fiber suspension within said discharge nozzle, said at least one ultrasonic transducer comprising a single ultrasonic transducer extending substantially across said width of said discharge nozzle.

7. A method of deflocculating a fiber suspension in a headbox of a paper-making machine, said method comprising the steps of:

providing the headbox with a discharge nozzle which continuously tapers to and terminates at an outlet;

providing a source of ultrasonic energy connected and disposed immediately adjacent to said discharge nozzle of the headbox upstream from said outlet, said source of ultrasonic energy extending continuously across a width of said discharge nozzle;

moving the fiber suspension along a path through said discharge nozzle of the headbox and past said source of ultrasonic energy so as to agitate and disperse the fiber suspension and thereby deflocculate the fiber suspension; and causing a fluid shear in the fiber suspension as the fiber suspension flows through said discharge nozzle of the headbox.

* * * * *